US008123575B2

(12) United States Patent
Ukai

(10) Patent No.: US 8,123,575 B2
(45) Date of Patent: Feb. 28, 2012

(54) CRIMPING TERMINAL FITTING, METHOD OF FORMING IT AND WIRE WITH TERMINAL FITTING

(75) Inventor: Eiko Ukai, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/839,449

(22) Filed: Jul. 20, 2010

(65) Prior Publication Data

US 2011/0021092 A1 Jan. 27, 2011

(30) Foreign Application Priority Data

Jul. 24, 2009 (JP) ..... 2009-173396
May 25, 2010 (JP) ..... 2010-119642

(51) Int. Cl.
*H01R 4/10* (2006.01)

(52) U.S. Cl. ..... 439/877

(58) Field of Classification Search ..... 439/877, 439/397, 400, 406, 867, 879
See application file for complete search history.

(56) References Cited

U.S. PATENT DOCUMENTS

| | | | | |
|---|---|---|---|---|
| 4,847,993 | A * | 7/1989 | Lin | 29/874 |
| 4,922,058 | A * | 5/1990 | Rodrigues | 174/94 R |
| 5,695,352 | A * | 12/1997 | Abe | 439/223 |
| 5,913,695 | A * | 6/1999 | Okabe | 439/397 |
| 6,565,377 | B2 * | 5/2003 | Sawayanagi et al. | 439/422 |
| 7,494,388 | B2 * | 2/2009 | Kakuta | 439/879 |
| 7,713,100 | B2 * | 5/2010 | Hernandez et al. | 439/884 |
| 7,803,008 | B2 * | 9/2010 | Onuma | 439/442 |
| 2008/0214065 | A1 * | 9/2008 | Kumakura | 439/877 |

FOREIGN PATENT DOCUMENTS

JP 3005065 9/1994

* cited by examiner

*Primary Examiner* — Jean F Duverne
(74) *Attorney, Agent, or Firm* — Gerald E. Hespos; Michael J. Porco

(57) ABSTRACT

A crimping terminal fitting has a wire barrel (21) to be crimped and connected to core strands (31) of a wire (30). The wire barrel (21) has a base plate (23) continuously extending from a ground terminal (11) in a longitudinal direction. Two core crimping pieces (25) extend from the opposite sides of the base plate (23). A thinned portion (27) is formed at least at a leading end of each core crimping piece (25) and is thinner than the base plate (23).

8 Claims, 8 Drawing Sheets

CRIMPING TERMINAL FITTING, METHOD OF FORMING IT AND WIRE WITH TERMINAL FITTING

BACKGROUND OF THE INVENTION

1. Field of the Invention

The invention relates to a crimping terminal fitting, a method of forming it and a wire with a terminal fitting.

2. Description of the Related Art

Japanese Registered Utility Model Publication No. 3005065 discloses a terminal fitting that is crimped and connected to an end portion of a wire. Terminal fittings of this type are used for wiring in automotive vehicles and the like.

This crimping terminal fitting includes a wire barrel to be crimped and connected to core strands of a wire and an insulation barrel portion to be crimped and connected to an insulation coating of the wire. Both barrels initially are open and are produced by press-working a single metal plate. The wire barrel includes two core crimping pieces. The core crimping pieces are deformed inwardly to wrap around the core strands of the wire and the leading ends of the core crimping pieces thrust themselves between the core strands to complete the crimping.

The thickness of a metal plate material used to produce a terminal fitting of this kind is determined in view of mechanical strength required for the terminal fitting. On the other hand, the size of a wire to be connected with the terminal fitting by crimping is determined in view of current capacity. Thus, the plate thickness of the terminal fitting becomes relatively excessively large as compared with the wire size if the current capacity is small even though a relatively high strength is required.

A metal plate material with a uniform thickness has been used for terminal fittings. Thus, a relatively thick wire barrel is crimped and connected to thin core strands of a wire and the leading ends of the wire barrel cannot properly thrust themselves between the core strands. Thus, there are problems of increasing contact resistance with the wire and decreasing a wire holding force. An extremely large number of crimping terminal fittings of this type are used per vehicle. Accordingly, further weight saving have been requested as a part of weight saving of the entire vehicle.

The invention was developed in view of the above situation and an object thereof is to provide a light weight crimping terminal fitting that can be crimped and connected properly even to a thin wire.

SUMMARY OF THE INVENTION

The invention relates to a crimping terminal fitting with a wire barrel that includes a base plate and at least one core crimping pieces extending from the base plate. The core crimping piece has at least one thinned portion that is thinner than the base plate. The thinned portion may be at an intermediate position of its longitudinal extension.

The crimping terminal fitting preferably has two core crimping pieces extending from the opposite sides of the base plate. Thinned portions that are thinner than the base plate are formed at least at leading end sides of the core crimping pieces.

The core crimping pieces that are crimped and connected to the core strands of a wire preferably are made thinner without changing the thickness of the base plate that most influences the strength of the terminal fitting. Thus, it is possible to increase a force for holding a thin wire, to suppress contact resistance between the core strands and the crimping terminal fitting and to maintain the strength of the crimping terminal fitting. Further, the core crimping pieces with the thinned portions save weight.

The thinned portions may be formed by partly flattening a conductive metal plate in a production process of the crimping terminal fitting. Accordingly, the crimping terminal fitting can be produced at a lower cost while using a similar material with a uniform thickness as before and adopting a pressing process similar to the conventional process.

The thinned portions of the core crimping pieces may be formed over more than about half of their entire areas and preferably over substantially their entire areas. Further weight saving are achieved by forming the thinned portions in wider areas.

Each thinned portion may include an oblique thickened portion with a thickness that gradually increases toward the base plate. Gradually increasing the thickness toward the base plate suppresses the concentration of a stress that would be caused by a sudden change in the thickness. Thus, the strength of the entire crimping terminal fitting can be maintained.

Inclined surfaces may be formed by beveling leading edges of the thinned portions. The inclined surfaces enable a thrust into the core strands to be adjusted while maintaining the strength of the core crimping pieces. Thus, wire breakage caused by an excessive thrust of the wire barrel into the core strands and an insufficient strength caused by thinning the core crimping pieces can be dealt with.

The thickness of the wire barrel may gradually change from the base plate to the thinned portions. Thus, the strength of the crimping terminal fitting can be increased and the crimping terminal fitting can be made lighter as compared with a terminal where parts of the wire barrel are thinned locally to form thinned portions.

The wire barrel has an inner surface that contacts the wire and an opposite outer surface. The inner surface may be substantially flat. However, the outer surface may include one or more steps and/or inclined surfaces at boundaries between the thinned portions and the thicker portions of the core crimping pieces or the base plate. The formation of the steps or the inclined surfaces on only the outer surface enables the core crimping pieces to be bent inwardly with ease for efficient crimped connection to the wire.

The invention also relates to a method of forming a crimping terminal fitting. The method comprises providing a conductive plate having a specified shape and a substantially uniform thickness, and thinning one or more parts of the conductive plate that will correspond to at least selected areas of the core crimping pieces.

The invention also relates to a wire with the above-described crimping terminal fitting. The wire has core strands exposed at an end. The core crimping pieces of the crimping terminal fitting are crimped to wrap at least partly around the core strands at the end of the wire. An average thickness of the core crimping pieces after the crimping is smaller than an average thickness of the base plate portion after the crimping. Thus, the wire with the terminal fitting can be made lighter while ensuring a necessary terminal strength. Further, the combination ensures mechanical strength of the wire itself, increases a holding force between the wire and the terminal fitting and suppresses contact resistance between the wire and the terminal fitting to a low level.

The thickness of the base plate is subject to variation depending on crimping conditions of the wire barrel. More particularly, the base plate easily becomes thinner by increasing a compression rate. On the other hand, the core crimping pieces are not thinned significantly by a high compression rate. Accordingly, the core crimping pieces may be thinner than the base plate before crimping is smaller than the base plate. However, the thicknesses of the core crimping pieces and the base plate after crimping may be equalized by setting a relatively high compression rate.

Equal transmission of a load to the core strands is expected to be difficult if the thickness of a part of the wire barrel surrounding the core strands is not uniform after crimping. More particularly, thermal expansion/contraction in a plate thickness direction due to temperature differences during a heat-cycle endurance test varies significantly between thick and thin parts, and hence the effect of temperature on the loads varies in accordance with the thickness. The load level affects contact resistance. Accordingly, the thickness of the part of the wire barrel surrounding the core strands preferably is uniform after crimping.

Consideration has been given to flattening both the core crimping pieces and the base plate to achieve a desired thinning of the core crimping pieces before the crimping. However, the flatness of the base plate is reduced if the both core crimping pieces and the base plate portion are thinned and a leading end portion of the terminal easily can be warped vertically with respect to the base plate (bent-up or bent-down). Thus, the base plate easily can be displaced when placed on a base of a crimper, thereby hindering the crimping. Accordingly, it is preferable to flatten only the core crimping pieces without hammering the base plate.

In view of these facts, the thickness after crimping of a part of the wire barrel surrounding the core strands preferably is substantially uniform over the entire circumference. "Substantially uniform" does not mean perfectly uniform and includes errors of about ±20% with respect to a desired thickness.

According to this construction, a load can be given equally to the core strands since the thickness of the part of the wire barrel surrounding the core strands after the crimping is substantially uniform. Thus, contact resistance becomes stable in an initial state before an endurance test and even after an endurance test is conducted.

The base plate may be thicker than the core crimping pieces before crimping. However, the base plate and the core crimping pieces may have substantially the same thickness after crimping by lowering a crimping die to press the base plate after the base plate is placed on a base of a crimper. Accordingly, the base plate will not be displaced during crimping since the flatness of the base plate need not be reduced.

If a first base end denotes a position where a first core crimping piece deviates from a first virtual plane as an extension of the outer surface of the first core crimping piece and a second base end denotes a position where a second core crimping piece deviates from a second virtual plane as an extension of the outer surface of the second core crimping piece. The base plate before crimping may be formed between the first and second base ends in a width direction in which both core crimping pieces are substantially facing. Accordingly, the opposite widthwise ends of the base plate will not interfere with the crimping die during crimping since the base plate is not outside the first and second base ends in the width direction in which the core crimping pieces face.

The opposite widthwise surfaces of the base plate preferably extend in a vertical direction orthogonal to the width direction. Accordingly, angles of bent parts between the opposite widthwise surfaces of the base plate and the core crimping pieces are approximated to 180°. Thus, stress will not concentrate on the bent parts to form cracks and other undesirable situations upon bending the core crimping pieces inwardly.

The crimping terminal fitting may further include at least one insulation barrel to be crimped and connected to an insulation coating of the wire. The insulation barrel may include a base plate and coating crimping pieces projecting obliquely up from opposite lateral sides of the base plate. The coating crimping pieces preferably have thicknesses before crimping that exceed thicknesses of the core crimping pieces before crimping.

An insulation coating of a thin wire is likely to be damaged if a thin insulation barrel is crimped and connected to the insulation coating. However, the coating crimping pieces are thicker than the both core crimping pieces before crimping. Accordingly, the thick insulation barrel is not likely to damage the insulation coating and the thin wire barrel can be crimped and connected properly to core strands of the thin wire. Thus, the crimping terminal fitting can be crimped properly and connected even to a thin wire while making the crimping terminal even lighter.

These and other objects, features and advantages of the invention will become more apparent upon reading the following detailed description of preferred embodiments and accompanying drawings. Even though embodiments are described separately, single features thereof may be combined to additional embodiments.

DETAILED DESCRIPTION OF THE PREFERRED EMBODIMENTS

Figure 1:
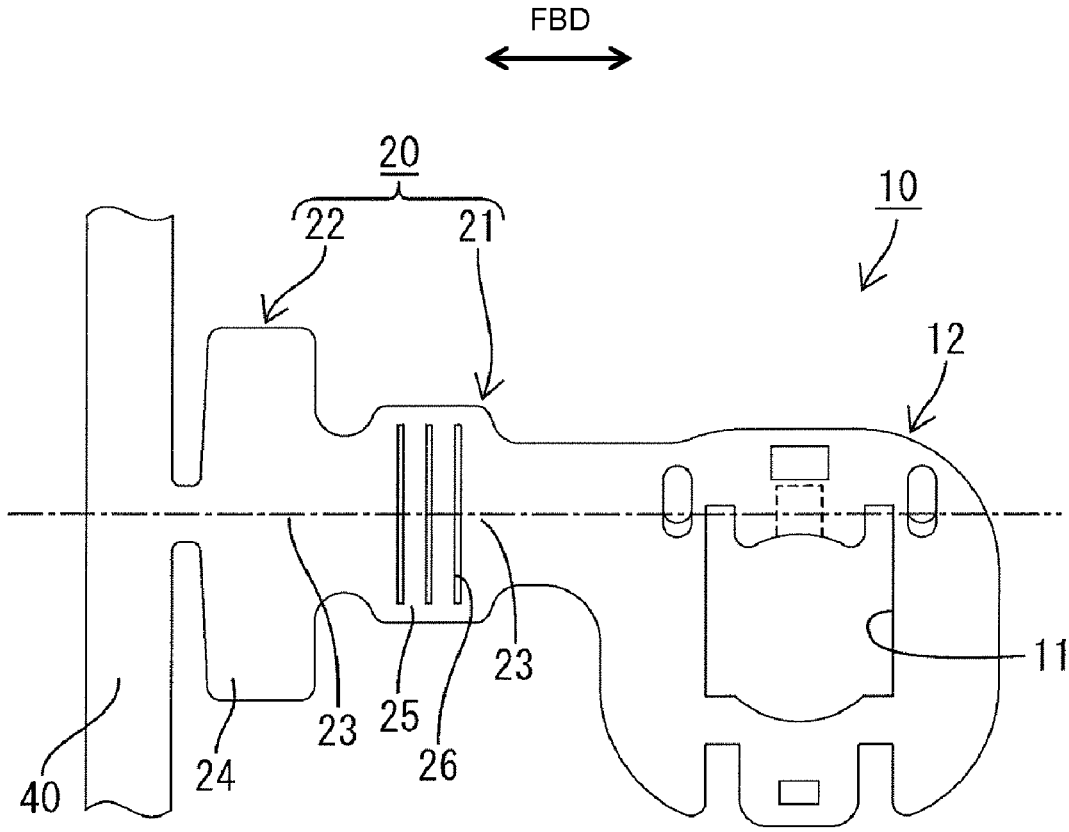
FIG. 1 is a developed view of a crimping terminal fitting of a first embodiment.

A crimping terminal fitting 10 in accordance with a first embodiment of the invention is identified by the numeral 10 in FIGS. 1 to 5. The crimping terminal 10 is formed by punching out or cutting a conductive metal plate into a specified shape, as shown in FIG. 1, and then bending, folding and/or embossing the cut parts. Lateral directions of FIG. 1 are referred to herein as forward and backward directions FBD.

Figure 2:
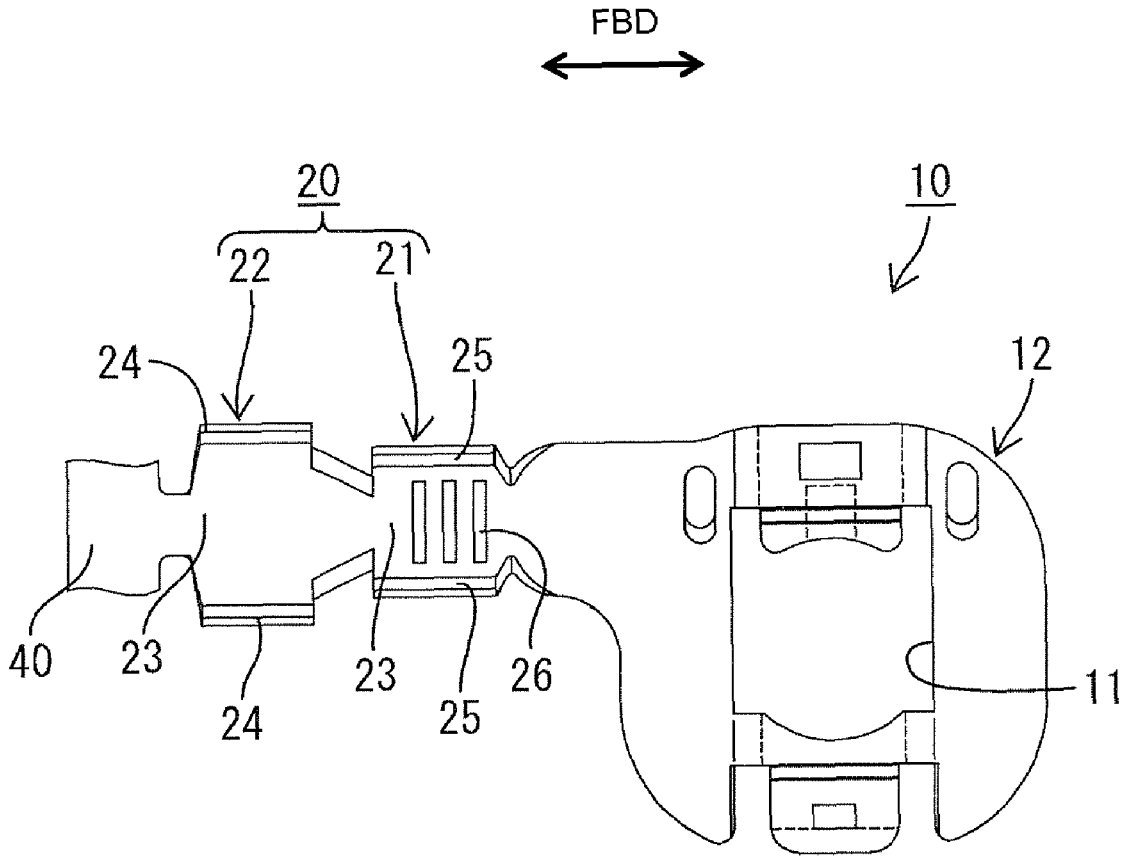
FIG. 2 is a plan view of the crimping terminal fitting.
Figure 3:
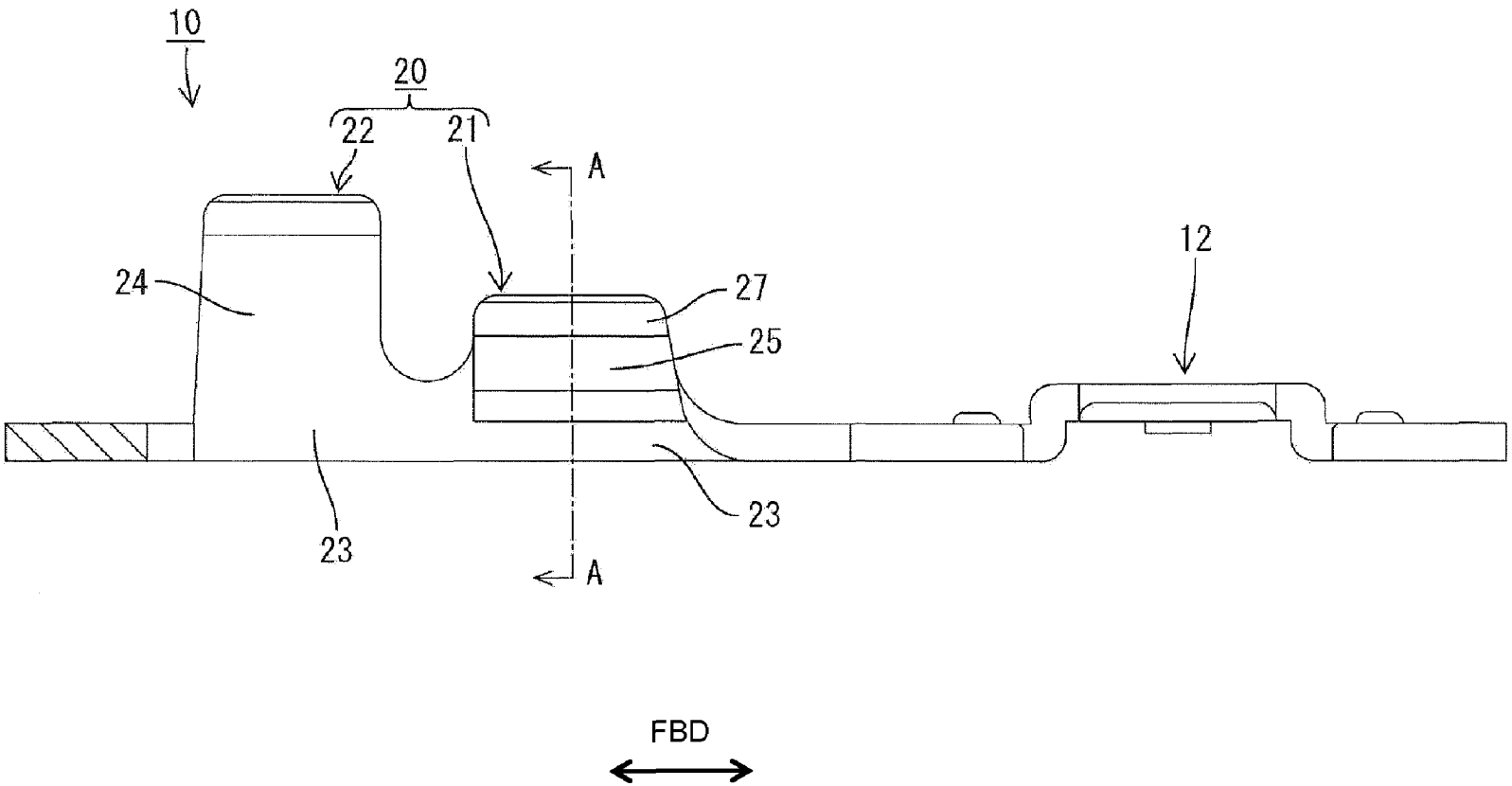
FIG. 3 is a side view of the crimping terminal fitting.

As shown in FIGS. 2 and 3, an open barrel-shaped wire crimping portion 20 is formed at a front part of the crimping terminal fitting 10 and a ground terminal 12 is formed at a rear part of the crimping terminal fitting 10. The ground terminal 12 is to be fixed, for example, to the body of a vehicle by a bolt (not shown) inserted through a bolt insertion hole 11 while being united with another crimping terminal fitting 10 that may be of substantially the same type. The wire crimping portion 20 has a wire barrel 21 (see FIG. 2) to be crimped, bent or folded into connection with one or more core strands 31 (see FIG. 5) of the wire 30 and an insulation barrel 22 (see FIG. 2) to be crimped, bent or folded into connection with an unillustrated insulation coating of the wire 30.

The insulation barrel 22 has a known construction with a substantially U-shaped cross section defined by a base plate 23 and two crimping pieces 24 extending obliquely up from opposite lateral sides of the base plate 23. The unillustrated insulated coating of the wire 30 is placed the base plate 23.

On the other hand, the wire barrel 21 includes a base plate 23 and two crimping pieces 25, as shown in FIGS. 2 and 3. The base plate 23 extends continuously in a longitudinal direction from the insulation barrel 22 and the core strands 31 of the wire 30 can be placed on the base plate 23. The crimping pieces 25 project obliquely up at an angle of between about 60° to about 120° to the base plate portion 23) from opposite lateral sides of the base plate 23. Thus, the wire barrel 21 has a substantially U-shaped cross section when viewed in a direction crossing the longitudinal direction of the wire 30 (see FIG. 4). The core crimping pieces 25 do not project as high as the coating crimping pieces 24.

Elongated recesses 26 are formed on the inner bottom surface of the base plate 23 and lower parts of the core crimping pieces 25. The recesses 26 extend in a direction intersecting (preferably substantially orthogonal to) the longitudinal direction of the wire 30 (see FIGS. 1 and 2) and function to reduce contact resistance between the wire 30 and the base plate 23 connected by crimping.

Figure 4:
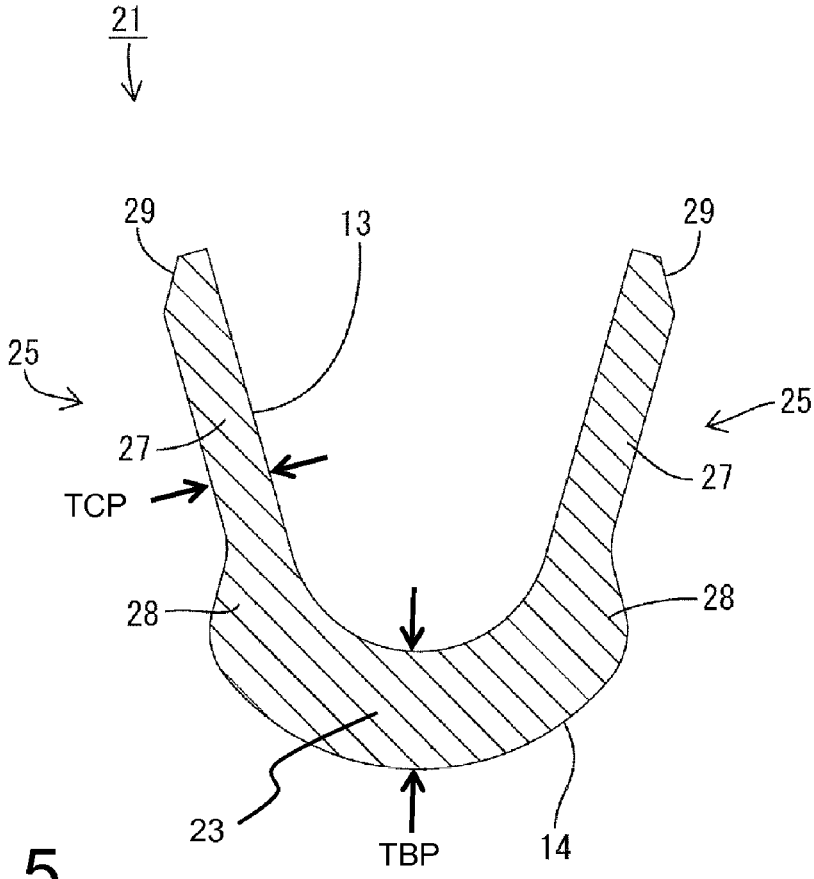
FIG. 4 is a section along A-A of FIG. 3.

FIG. 4 is a cross section of the wire barrel 21 taken along a line normal to the longitudinal direction of the wire 30 and shows that substantially the entirety of each core crimping pieces 25 is thinner than the base plate 23. More particularly, the thickness TBP of the base plate 23 exceeds the thickness TCP of the core crimping pieces 25. The thickness TBP of the base plate 23 is substantially uniform in its entire area and the thickness TCP of each core crimping pieces 25 is substantially uniform in substantially its entire areas except the distal ends where bevels 29 are formed. Thus, a thinned portion 27 with a thickness TCP less than the thickness TBP of the base plate 23 is defined at least on an intermediate portion each core crimping piece 25 along its longitudinal extension between a distal end or bevel 29 thereof and areas of the crimping terminal 10 near the base plate 23. The thinned portion 27 may extend over substantially the entire longitudinal extension of the core crimping piece 28. Inner surfaces 13 to be held in contact with the core strands 31 of the wire 30 are substantially flat. However, obliquely thickened transitional portions 28 are formed at boundaries of an outer surface 14 between the base plate 23 and the core crimping pieces 25. The thickness of the transitional portions 28 gradually decreases from the base plate 23 to the thinned portions 27. The bevels 29 at the leading end edges of the outer surfaces of the core crimping pieces 25 are even thinner than the thinned portions 27.

A plurality the crimping terminal fittings 10 are formed from a strip-shaped metal plate and are connected by a carrier 40, as shown in FIGS. 1 and 2. The carrier 40 is separated at a final stage of a pressing process. The crimping terminal fittings 10 protrude substantially perpendicularly from the longitudinal extension of the carrier 40.

The crimping terminal fitting 10 can be produced from a conductive metal plate, such as a copper alloy or an aluminum alloy, of substantially uniform thickness. The plate then is subjected to a stamp pressing process for bending necessary parts while punching or cutting at necessary positions to achieve a developed shape, as shown in FIG. 1. The pressing process includes thinning parts of the conductive metal plate to become the core crimping pieces 25. The thinning is achieved by squeezing and flattening these parts between molds of a specified gap. The thinned portions 27 and the oblique thickened portions 28 are formed by flattening the conductive metal plate at the outer surface 14 opposite to the sides of the core crimping pieces 25 to be crimped and connected to the core 31. Shearing and bending processes then are performed for cutting the core crimping pieces 25 off from the conductive metal plate and bending the crimping terminal fitting 10.

Figure 5:
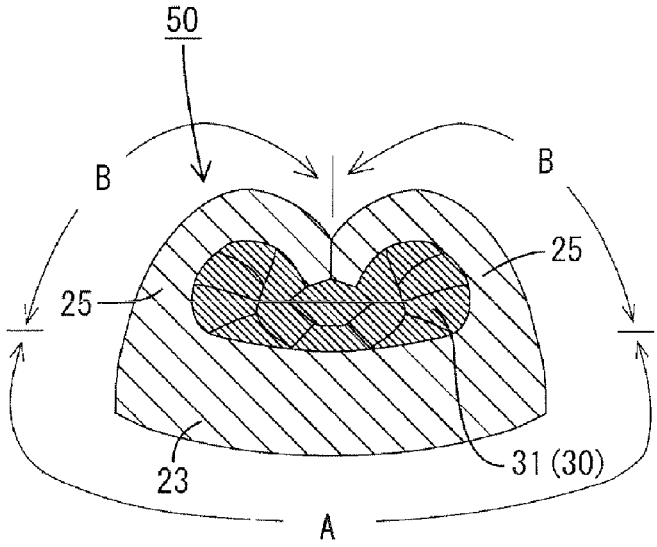
FIG. 5 is a section of a wire barrel of a wire with a terminal fitting according to the first embodiment.

The crimping terminal fitting 10 may be crimped, bent or folded into connection with the wire 30 through the crimping process to produce the wire with the terminal fitting 50. The crimping terminal fitting 10 is mounted on a base of an unillustrated crimper and an unillustrated known crimping die is lowered to crimp and connect the crimping terminal fitting 10 to the wire 30. More particularly, the core crimping pieces 25 are curled in toward an axial center portion of the crimping terminal fitting 10 by an unillustrated crimping jig. Thus, the base plate 23 and the core crimping pieces 25 wrap around the core strands 31, as shown in FIG. 5. The bevels 29 at the leading ends of the core crimping pieces 25 are thrust between the core strands 31 to achieve close contact.

The base plate 23 and the core crimping pieces 25 are flattened and plastically deformed by the crimping die. Thus, the oblique thickened portions 28 between the core crimping pieces 25 and the base plate 23 before the crimping process cannot be observed clearly as shown in FIG. 5, and an average thickness of the core crimping pieces 25 in the entire areas shown by B in FIG. 5 after crimping is smaller than an average thickness of the base plate 23 in the entire area shown by A in FIG. 5 after the crimping.

The thickness of the core crimping pieces 25 to be crimped into connection with the core strands 31 of the wire 30 can be made thinner without changing the thickness of the base plate 23 that most influences the strength of the crimping terminal fitting 10. Thus, the crimping terminal fitting 10 and the wire with the terminal fitting 50 have an increased force for holding the wire 30 and reducing contact resistance between the core strands 31 and the crimping terminal fitting 10 to a low level even if the wire 30 is thin while maintaining the strength of the crimping terminal fitting 10 itself.

The thicknesses of conventional crimping terminal fittings are uniform. However, the core crimping pieces 25 of the invention have the thinned portions 27 that are thinner than the base plate 23. Thus, the crimping terminal fitting 10 can be made lighter by as much as the thickness TCP of the core crimping pieces 25 is reduced. Further, the bevels 29 at the leading ends of the thinned portions 27 enable the ends of the wire barrel 21 to be thrust more easily between the core stands 31, thereby further increasing the wire holding force of the crimping terminal fitting 10.

The oblique thickened portions 28 vary in thickness only on the outer surface 14, which is opposite to the inner surfaces 13 that are crimped into connection with the core strands 31. Thus, the core crimping pieces 25 can be curled more easily toward the core strands 31. The gradual increase of the thickness at the oblique thickened portions 28 prevents a concentration of stresses at locations where the thickness changes and the strength of the thinned portions 27 is maintained.

A second embodiment of the invention is described with reference to FIGS. 6 to 10. Reference numerals of the first embodiment+100 are used to denote elements of this embodiment corresponding to the first embodiment. Construction, functions and effects of this embodiment corresponding to those of the first embodiment are not described.

Figure 9:
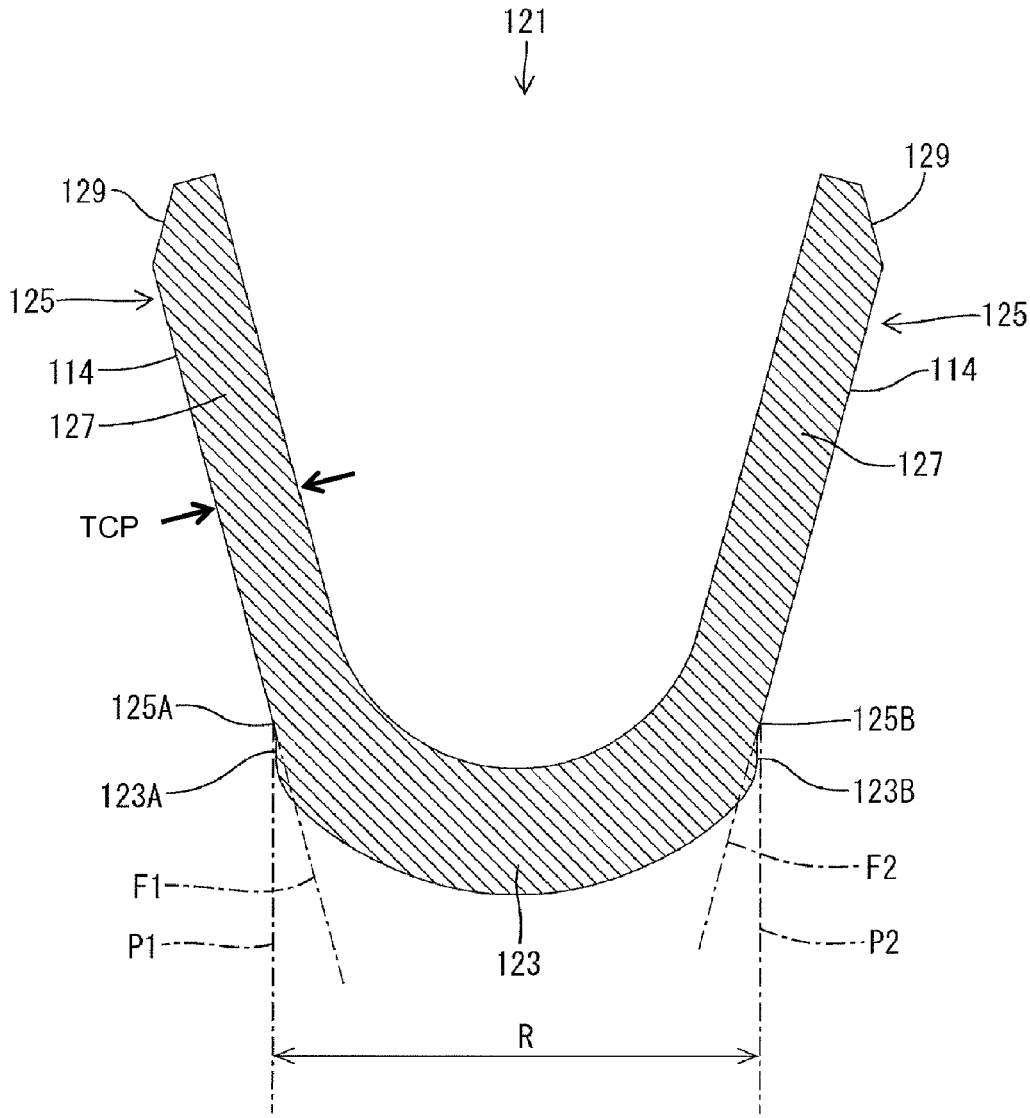
FIG. 9 is a section along B-B of FIG. 8.
Figure 10:
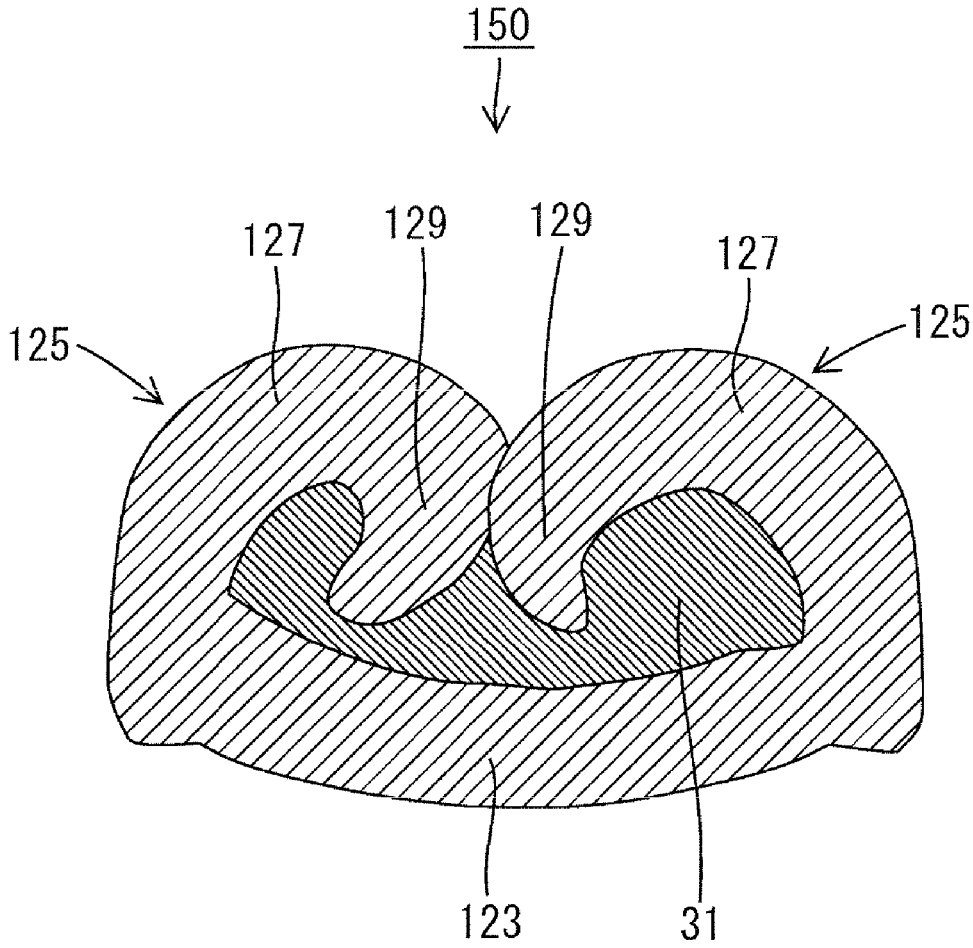
FIG. 10 is a section of a wire barrel of a wire with a terminal fitting according to the second embodiment.

As can be understood from a comparison of FIGS. 5 and 10, a crimping terminal fitting 110 of this embodiment differs from the crimping terminal fitting 10 of the first embodiment in that a base plate 123 and core crimping pieces 125 have substantially the same thickness in the crimped state of the core crimping pieces 25, 125. Further, as can be understood from a comparison of FIGS. 4 and 9, areas of thickened portions 128 around the base plate 123 are smaller than in the first embodiment.

The crimping terminal fitting 110 is formed, for example, by bending a conductive metal plate that has been punched out or cut into a specified shape and then bending the cut parts. Further, an assembly 150 of a wire 30 with the terminal fitting 150 of this embodiment is formed by crimping, bending or folding this crimping terminal fitting 110 to an end portion of a wire 30.

Figure 7:
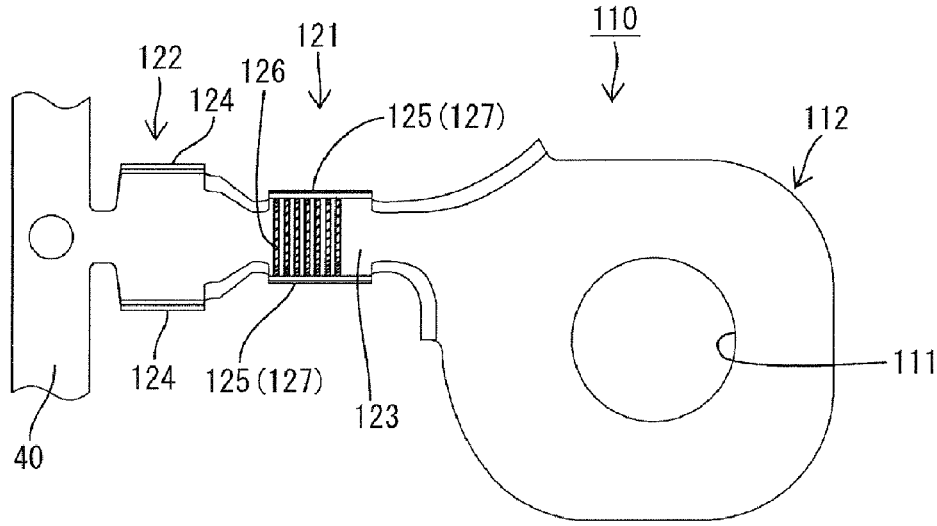
FIG. 7 is a plan view showing the crimping terminal fitting before being cut off into a single piece after the both core crimping pieces are bent in the production process.

As shown in FIG. 7, the crimping terminal fitting 110 includes a ground terminal portion 112 formed with a bolt insertion hole 111. The ground terminal portion 112 has a substantially rectangular outer shape with rounded corners. A stud bolt (not shown) can be inserted through the bolt insertion hole 111 and a nut (not shown) is tightened on the stud bolt so that the crimping terminal fitting 110 is fixed to the stud bolt and electrically connected (e.g. grounded).

A wire barrel 121 is formed before (to the left in FIG. 7) the ground terminal portion 112 and an insulation barrel 122 is formed before the wire barrel 121. The barrels 121, 122 include a common base plate 123. Two core crimping pieces 125 project from the base plate 123 at the wire barrel 121 and two coating crimping pieces 124 project from base plate 123 at the insulation barrel 122. The core crimping pieces 125 of the wire barrel 121 have thinned portions 127 with a thickness TCP in a range of about 0.3 mm to about 0.5 mm, (most preferably of 0.4 mm) and are by flattening a conductive metal plate with an initial thickness of about 0.6 mm as a base material of the crimping terminal fitting 110. On the other hand, the coating crimping pieces 124 of the insulation barrel 122 particularly are formed without flattening the metal plate and, hence, have the same thickness as the metal plate. Thus, the coating crimping pieces 124 are thicker than the core crimping pieces 125.

Figure 6:
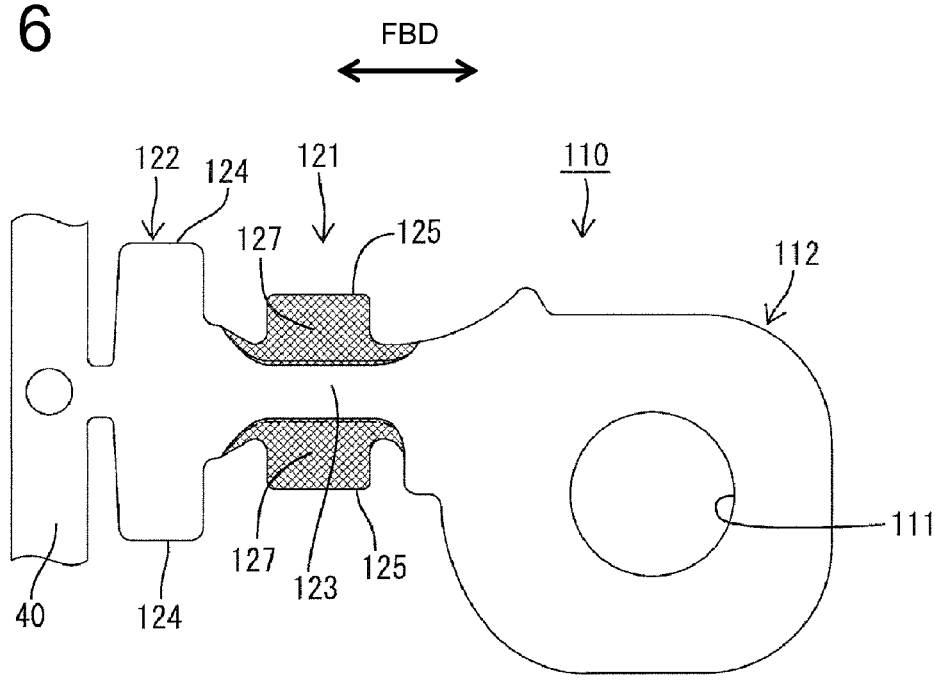
FIG. 6 is a plan view showing positions of thinned portions formed by flattening both core crimping pieces of a crimping terminal fitting of a second embodiment.

As shown in FIG. 6, the thinned portions 127 are formed by flattening and thinning parts corresponding to the core crimping pieces 125 of the wire barrel 121 in a developed state of the crimping terminal fitting 110 and, then, processing the outer sides of the thinned parts. For convenience, the top sides of the core crimping pieces 125 (sides to be held in contact with core strands 31) are cross-hatched in FIG. 6. The core crimping pieces 125 are thinned by being hammered from the under sides.

Figure 8:
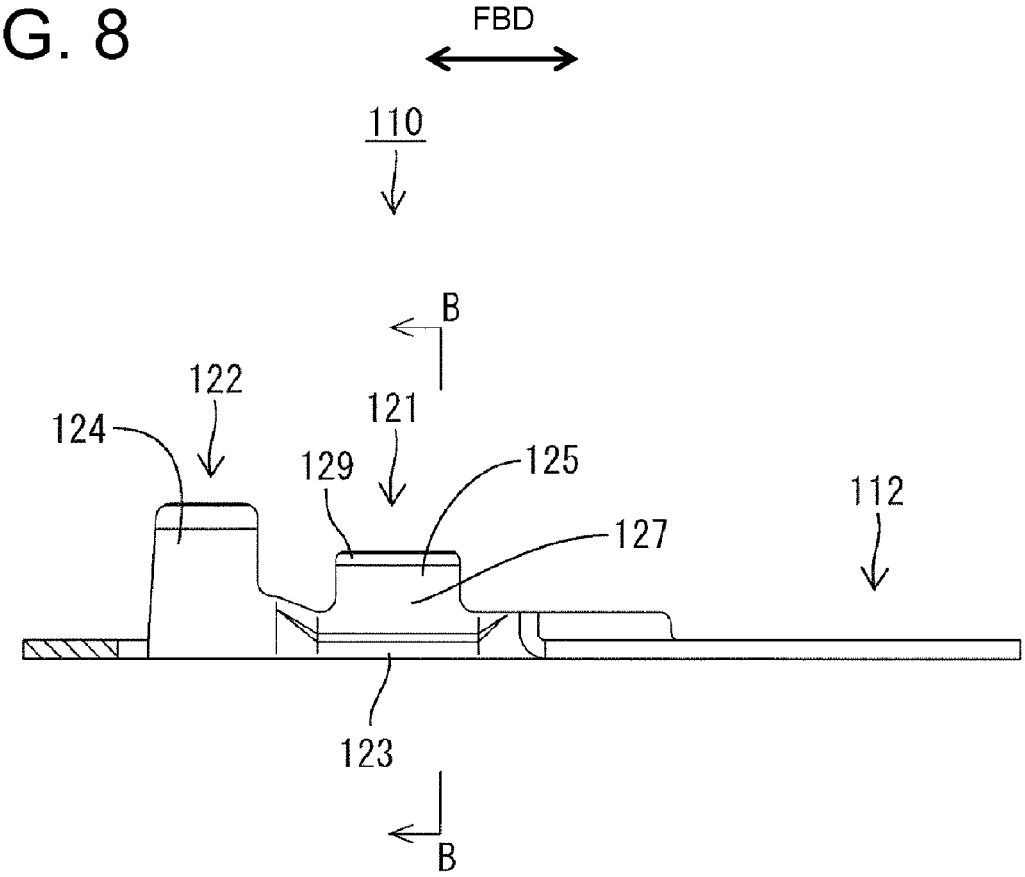
FIG. 8 is a side view of the crimping terminal fitting of FIG. 7.

FIG. 8 is a side view of the crimping terminal fitting 110 of FIG. 7. The ground terminal portion 112 is substantially flat. The base plate 123 forms the bottom of the wire barrel 121 and is substantially flat and continuous with the ground terminal portion 112. FIG. 9 is a vertical cross section of the wire barrel 121 taken along B-B of FIG. 8. The entire area of the base plate 123 of the wire barrel 121 is thicker than the core crimping pieces 125 because the core crimping pieces 125 have the thinned portions 127.

The thinned portions 127 are formed only in the core crimping pieces 125 and are not formed in the base plate 123. Thus, the flatness of the base plate 123 is not reduced and the base plate 123 is not likely to displace when being placed on a base of a crimper. On the other hand, the core crimping pieces 125 have bevels 129 at their leading ends, and the bevels 129 are guided in along surfaces of a crimping die of the crimper during the crimping. Therefore, the core crimping pieces 125 are unlikely to be influenced by the flatness.

An arrangement area of the base plate 123 is described with reference to FIG. 9. A first base end 125A denotes a position where the left core crimping piece 125 deviates from a first virtual plane F1 as an extension of an outer surface 114 of the left core crimping piece 125. On the other hand, a second base end 125B denotes a position where the right core crimping piece 125 deviates from a second virtual plane F2 as an extension of an outer surface 114 of the right core crimping piece 125. P1 and P2 respectively denote left and right boundary lines vertically passing the first and second base ends 125A and 125B. R denotes an area defined by the left and right boundary lines P1, P2 with respect to a width direction (lateral direction in FIG. 9 orthogonal to vertical direction). Under such prerequisites, the base plate 123 is arranged in the area R.

The base plate 123 has left and right surfaces 123A, 123B that extend substantially vertically. Specifically, the left surface 123A of the base plate 123 is substantially parallel with the left boundary line P1 and is slightly to the right of the left boundary line P1. On the other hand, the right surface 123B of the base plate 123 is substantially parallel with the right boundary line P2 and is slightly to the left of the right boundary line P2. In other words, the left and right surfaces 123A, 123B do not project laterally beyond the left and right boundary lines P1, P2, so that they do not interfere with the crimping die during the crimping of the wire barrel 121.

Further, angles of bent parts between the left and right side surfaces 123A, 123B of the base plate 123 and the core crimping pieces 125 (i.e. both base ends 125A, 125B) preferably are close to 180°. Thus, stress will not concentrate on the bent parts and cracks will not form when the core crimping pieces 125 are bent inwardly.

The crimping terminal fitting 110 is crimped and connected to the wire 30 through a crimping process to produce an assembly 150 of the wire and the terminal fitting 150. In this process, the crimping terminal fitting 110 is placed and fixed on the base of the unillustrated crimper and the unillustrated known crimping die is lowered to crimp and connect the crimping terminal fitting 110 to the wire 30. More particularly, the core crimping pieces 125 of the wire barrel 121 are curled or bent inwardly by an unillustrated crimping jig and are introduced to an axial center portion of the crimping terminal fitting 110. Thus, the base plate 123 and the core crimping pieces 125 wrap around a group of core strands 31 as shown in FIG. 10. Additionally, the leading ends of the core crimping pieces 125 thrust themselves into the group of core strands and the bevels 129 are brought into close contact, thereby completing the crimping. On the other hand, the coating crimping pieces 124 of the insulation barrel 122 are crimped, bent or folded into connection with the insulation coating. The coating crimping pieces 124 are thicker than the core crimping pieces 125. Therefore, the insulation coating will not be damaged.

The crimping terminal fitting 110 of the second embodiment is crimped at a higher compression rate than the crimping terminal fitting 10 of the first embodiment. Thus, the base plate 123 partly escapes toward the core crimping pieces 125 or toward the front and rear ends of the wire barrel 121. Accordingly, the thickness of the base plate 123 after crimping becomes smaller than before crimping and becomes substantially equal to the thickness of the core crimping pieces 125 after the crimping. In other words, the thickness of the part of the wire barrel 121 surrounding the core strands 31 after the crimping is substantially uniform over the entire periphery so that a load is exerted equally to the core strands 31. Therefore, contact resistance becomes stable in an initial state before an endurance test is conducted and also after the endurance test is conducted.

As described above, the thickness of the part of the wire barrel 121 surrounding the core strands 31 is substantially uniform over the entire periphery after crimping. Therefore the contact resistance is stable in the initial state and after the endurance test. Further, the thinned portions 127 are formed in both core crimping pieces 125. Thus, a thin wire 30 can be fastened including core strands of about 0.5 sq ($mm^2$) to 2 sq by both core crimping pieces 125. Here, the thinned portions 127 are formed by hammering only the core crimping pieces 125. Thus, the flatness of the base plate 123 is maintained and a displacement of the base plate 122 during crimping is avoided.

The base plate 123 is formed entirely as the thick portion and is arranged in the area R. The left and right surfaces 123A, 123B of the base plate 123 do not project leftward and rightward beyond the boundary lines P1, P2. Therefore, the left and right surfaces 123A, 123B will not interfere with the crimping die during crimping. Furthermore, the left and right surfaces 123A, 1238 of the base plate 123 extend substantially vertically and the bending angles at the base ends 125A, 125B are approximately 180°, thereby preventing a concentration of stresses on the base end portions 125A, 125B and avoiding cracks. Additionally, the thick insulation barrel 122 is crimped and connected to the insulation coating. Thus, the crimping terminal fitting 110 can accommodate a thin wire by crimping and connecting the thin wire barrel 121 to core strands while preventing the insulation coating from being damaged.

The invention is not limited to the above described and illustrated embodiments. For example, the following embodiments are also included in the technical scope of the present invention.

The wire barrel 21, 121 is formed by punching out the plate material with the constant thickness and then flattened to form the thinned portions 27, 127 in the above embodiments. However, the conductive plate may be a material with a varying thickness without being limited to the above plate material. Production efficiency can be improved if a material is used with a varying thickness in which parts to become the thinned portions 27, 127 have a small thickness. Thus, the step of forming the thinned portions 27, 127 by flattening the plate material becomes unnecessary.

In the first embodiment, each thinned portion 27 has parts with a thickness that gradually changes, such as the oblique thickened portion 28 and the bevel 29 and a part thinner than the base plate 23 and having a uniform thickness. However, the invention is not so limited, and recesses may be formed in a scattered matter at least at the leading end of each core crimping piece 25 to become locally thinner and this area may serve as the thinned portion 27.

Although the thinned portions 27, 127 are formed only in the wire barrel 21, 121 in the above embodiments, they may be also formed, for example, in the insulation barrel 22, 122 to make the crimping terminal fittings 10, 110 even lighter.

Three elongated recesses 26 are formed from the inner bottom surface of the base plate 23 and extend to areas the core crimping pieces 25 in the wire barrel 21 in the first embodiment. However, a multitude of recesses may be formed in a scattered manner without being limited to the elongated recesses 26. In other words, knurled serrations 126 may be formed as in the second embodiment.

The oblique thickened portions 28 whose thickness continuously changes are provided at the boundaries between the base plate 23 and the core crimping pieces 25 in the above embodiment. However, steps whose thickness discontinuously change may be provided at the boundaries. Further, the oblique thickened portions 28 or the steps are formed on the outer surface 14 of the wire barrel 21 and the inner surface 13 of the wire barrel 21 are flat. However, the oblique thickened portions 28 or the steps may be formed at the boundaries between the base plate and the thinned portions only on the inner side surface 13 or may be formed both on the inner and outer surfaces 13 and 14.

The entire base plate 123 is the thickened portion in the second embodiment. However, only a part of the base plate 123 may be the thickened portion according to the invention. Although the parts of the base plate 123 escape toward both core crimping pieces 125 and toward the front and rear ends during the crimping in the second embodiment, parts of both core crimping pieces 125 may escape toward the base plate 123 and toward the front and rear ends during crimping according to the invention. In this case, both core crimping pieces 125 may be formed as the thickened portions.

Although both coating crimping pieces 124 are formed to be relatively thicker than the both core crimping pieces 125 in the second embodiment, they may be formed to be as thin as the core crimping pieces 125 if there is no problem of damage and the like of the insulation coating.

What is claimed is:

1. A crimping terminal fitting, comprising: a wire barrel with an inner surface disposed and configured for engaging a wire, an outer surface opposite to the inner surface and a thickness extending between the inner and outer surfaces, the wire barrel including a base plate and core crimping pieces extending in a longitudinal extension direction from the base plate each core crimping piece having a thickness dimension that is thinner than a thickness dimension of at least areas of the base plate offset from the core crimping pieces in a direction transverse to the longitudinal extension direction of the core crimping pieces.

2. The crimping terminal fitting of claim 1, wherein each of the core crimping pieces includes an oblique thickened portion with a thickness that gradually increases toward the base plate.

3. The crimping terminal fitting of claim 1, wherein bevels are formed at leading edges of the of the core crimping pieces opposite the base plate.

4. The crimping terminal fitting of claim 1, wherein the thickness of the wire barrel gradually changes from the base plate to the core crimping pieces.

5. The crimping terminal fitting of claim 1, wherein, the inner surface being substantially flat, and the outer surface including at least one step or inclined surface at boundary parts of the core crimping pieces.

6. The crimping terminal fitting of claim 1, further comprising a wire with core strands exposed at an end, the core crimping pieces being crimped to wrap at least partly around the core strands and connect to the core strands, an average thickness of the core crimping pieces after the crimping being smaller than an average thickness of the base plate after the crimping.

7. The crimping terminal fitting of claim 1, further comprising at least one insulation barrel to be crimped and connected to an insulation coating of the wire, the insulation barrel including a base plate and coating crimping pieces projecting obliquely up from the base plate, the coating crimping pieces before the crimping being thicker than the core crimping pieces.

8. A crimping terminal fitting comprising: a wire barrel including a base plate and core crimping pieces extending in a longitudinal extension direction from the base plate, at least an intermediate position of each of the core crimping pieces in the longitudinal extension direction having at least one thinned portion thinner than the base plate, wherein the core crimping pieces comprise first and second core crimping pieces, the first core crimping piece having an outer surface defining a first virtual plane before crimping and a first base end that deviates from the first virtual plane, and the second core crimping piece having an outer surface defining a second virtual plane before crimping and a second base end that deviates from the second virtual plane, the base plate before crimping being between the first and second base end portions in a width direction in which the core crimping pieces are substantially facing, opposite widthwise surfaces of the base plate extending in a substantially vertical direction orthogonal to the width direction.

* * * * *